United States Patent [19]

Schlueter

[11] 3,937,143

[45] Feb. 10, 1976

[54] DEVICE FOR POINT IGNITION OF A CHARGE

[75] Inventor: Heinz Schlueter, Merfeld, near Duelmen, Germany

[73] Assignee: Wasag-Chemie GmbH, Munich, Germany

[22] Filed: Jan. 2, 1974

[21] Appl. No.: 429,884

Related U.S. Application Data

[63] Continuation of Ser. No. 847,565, Aug. 5, 1969, abandoned.

[30] Foreign Application Priority Data

Aug. 28, 1968 Germany ..... 1796082

[52] U.S. Cl. ..... 102/28 M

[51] Int. Cl.[2] ..... F42B 3/12

[58] Field of Search ..... 102/24 HC, 28 R, 28 M

[56] References Cited

UNITED STATES PATENTS

| | | | |
|---|---|---|---|
| 2,609,752 | 9/1952 | Jeffrey | 102/28 M |
| 3,162,122 | 12/1964 | Gurton et al. | 102/28 M |
| 3,437,036 | 4/1969 | Franzen et al. | 102/24 HC |

FOREIGN PATENTS OR APPLICATIONS

| | | | |
|---|---|---|---|
| 199,107 | 3/1957 | Austria | 102/28 M |

*Primary Examiner*—Verlin R. Pendegrass

*Attorney, Agent, or Firm*—Hammond & Littell

[57] ABSTRACT

A structural member is interposed between the primary pellet and a charge, the structural member having upper and lower open-ended chambers formed by walls of the structural member which converge towards an opening generally centrally located within the structural member providing communication between the chambers. The upper chamber serves to convey the sparks emitted by the priming pellet to the charge disposed in the lower chamber.

7 Claims, 10 Drawing Figures

FIG. 1
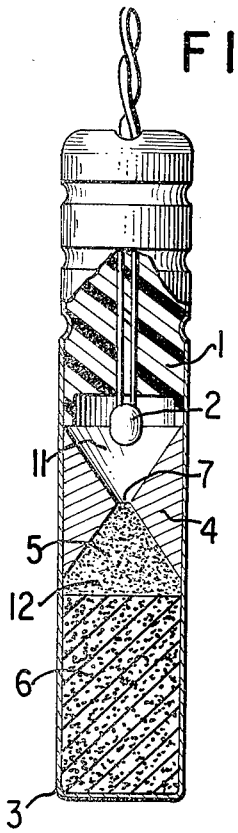
FIG. 2
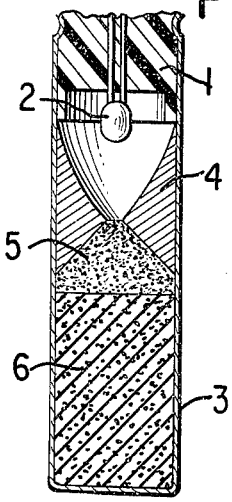
FIG. 3
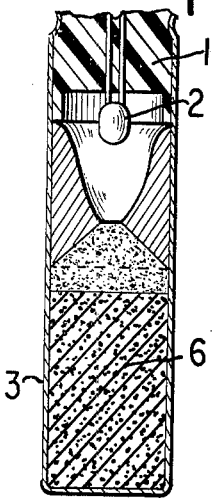
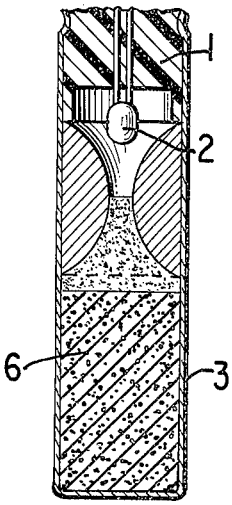
FIG. 4
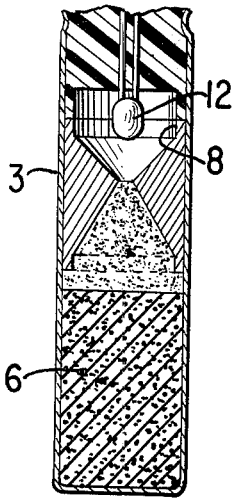
FIG. 5
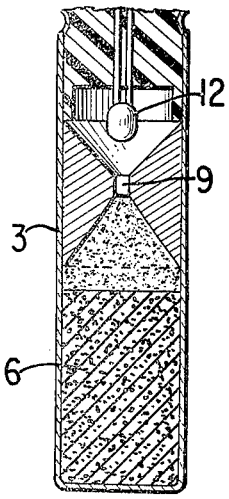
FIG. 6
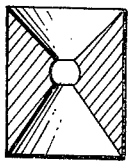
FIG. 7a
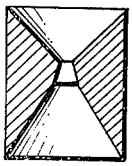
FIG. 7b
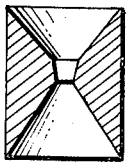
FIG. 7c
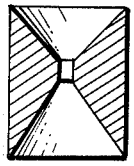
FIG. 7d
INVENTOR
HEINZ SCHLUTER
BY

DEVICE FOR POINT IGNITION OF A CHARGE

This is a continuation, of Ser. No. 847,565 filed Aug. 5, 1969, now abandoned.

BACKGROUND OF THE INVENTION

In the explosives art as it is known today, particularly in its application to military uses, a stringent requirement is placed on the igniter of an ignition charge. The ignition of a charge of an explosive device by means of blasting caps, electrical igniters, and detonators in general, is expected to be achieved with a maximum precision in a manner to effect the ignition of the charge at its geometric center. As is known, when a charge is ignited at a point other than its geometric center, the ignition front progresses from the ignition point in an oblique direction with respect to the geometrical center of the charge and ignition penetration of the charge is thereby considerably lessened.

In order to achieve an optimum performance, it has been attempted to position the igniter over the geometric center of the charge. This did not alleviate the problem since a conventional igniter is not guaranteed to effect ignition at a specific point. The primary pellets of the blasting caps are not always symmetric but hang a distance from the axis of the blasting caps or on the wall of the blasting cap shell. The shower of sparks emanating from the primary pellet moves in the inner cap at an oblique direction and impinges on the initiating charge not at the geometric center but at an edge thereof. As a result of this asymmetrical ignition, ignition front is generated which progresses obliquely to the axis of the charges and propagates itself in asymmetric fashion.

OBJECTS OF THE INVENTION

It is an object of this invention to provide for point ignition of a charge.

Another object of this invention is the provision of a structural member within an explosive device forming upper and lower communicating chambers which facilitate point ignition of a charge disposed in the lower chamber.

Another object of this invention is an explosive device wherein ignition of a charge is made at a point located on the axis of the charge irregardless of whether the primary pellet is positioned along the axis or off-axis.

DESCRIPTION OF THE INVENTION

This invention relates to an explosive device where ignition of an initiating charge can be precisely controlled. The ignition of the initiating charge is effected at its geometric center and ignition front progresses uniformly through the charge. The control of ignition of the charge is achieved by providing a structural member within the shell of the explosive device disposed above a secondary explosive charge. The structural member forms a pair of communicating chambers—the upper chamber serving to guide the shower of sparks originating with a priming pellet disposed in the upper chamber to a central point of the initiating charge, while the lower chamber serves as a container for the initiating charge.

The chambers may assume various shapes and sizes. It is not necessary that a set of communicating chambers be of the same size or shape—they may be of different size and shape. The shape of the chambers must be such that the sparks originating with the primary pellet are conveyed to the apex of the charge residing in the lower chamber. Although the shape and size of chambers may be different, the shape of the lower chamber should be one which is symmetrical with respect to its vertical axis. The communicating opening between the chambers may be elongated and assume cylindrical, frusto-conical, oblong and other forms. For a more detailed description of the invention, reference is hereby made to the drawings wherein FIG. 1 is a view of an explosive device partially in section;

FIG. 2,3,4 and 5 is a cross-sectional view of an explosive device illustrating the various shapes and sizes that the upper and lower chambers may assume.

FIG. 6 is a cross-sectional view of an explosive device illustrating a cylindrical opening which provides communication between the upper and lower chambers.

FIG. *7a–7d* illustrate other channel forms of communicating openings between the upper and the lower chambers. Referring to FIG. 1, shell 3 serves as a container for the explosive device which includes a secondary explosive charge 6 packed within the lower portion of the shell 3. Structural member 4, which can be made of metal or a non-metal, is disposed above the secondary explosive charge 6 and forms cone-shaped upper chamber 11 and a lower chamber 12. The height of the upper and lower chambers, with respect to the combined height $h$, is $h/2$, greater than $h/2$, or less than $h/2$. Access is provided from one chamber to the other by means of the opening 7. Within the upper chamber 11 is positioned a priming pellet 2 which can be set-off by electrical or thermal energy. The initiating charge 5 is packed and compacted into the lower chamber 12 with the aid of the structural member 4. Compaction of the charge 5 may be accomplished by inserting a die into the upper chamber of a complementary shape and tamping charge 5 until it is compacted to the desired degree. Enough of charge 5 should be introduced so that it completely fills the lower chamber 12. A plastic body 1 is packed above the structural member 4 and the explosive device is then sealed in a conventioanl manner, such as crimping.

FIGS. 2–6 illustrate other embodiments of the explosive device wherein the shape and size of the upper and lower chambers has been varied. However the upper and lower chambers have sloping walls sloping outwardly substantially to the inner wall of the shell. In FIG. 5, the structural member 4 is shown with a collar 8 which facilitates positioning of the plastic body 1 thereover. FIG. 6 additionally shows an opening 7 as a channel 9 in the cylindrical or channel form in apex-to-apex relationship. FIG. *7a–d*–depict other forms which the channel 9 can assume.

Actuation of the explosive device is accomplished by setting-off the primary pellet 2 which produces a shower of sparks. These sparks are conveyed by the sloping walls of the upper chamber 11 to the opening 7. It is immaterial whether the priming pellet is positioned within the upper chamber centrally along the axis of the opening 7 or off-center, since the sloping walls of the structural member 4 converge towards the opening 7.

When the sparks reach opening 7, they make contact with the initiating charge 5 at the apex thereof and ignite same. Since ignition of the initiating charge has been made centrally, the penetration of the ignition front through the charge 5 progresses uniformly across the charge. When the ignition front reaches the secondary explosive charge 6, ignition thereof will be effected substantially along its horizontal plane.

I claim:

1. Device for point-ignition of a charge comprising a shell; a priming pellet at the top of said shell; a secondary explosive charge at the bottom of said shell; an initiating charge above and completely abutting said secondary explosive charge and a structural member within said shell interposed between said priming pellet and said initiating charge; said structural member including upper and lower chambers having sloping walls sloping outwardly substantially to the inner wall of said shell and an opening lying on the vertical axis of said structural member providing communication between said chambers, said upper chamber serving to convey the sparks produced by said priming pellet to said opening and said lower chamber being completely packed with said initiating charge and being symmetrical with respect to the vertical axis; the inner walls of said structural member forming said chambers converging towards said opening.

2. Device of claim 1 wherein said chambers are conical in shape and situated in apex-to-apex relationship.

3. Device of claim 2 wherein the size and shape of the upper and lower conically-shaped chambers are different.

4. Device of claim 1 wherein the opening is in the form of a cylinder.

5. Device of claim 1 wherein the opening is in the form of a channel.

6. Device of claim 1 wherein said upper chamber and said lower chamber have the same height.

7. Device of claim 1 wherein said upper chamber and said lower chamber have different heights.

* * * * *